United States Patent [19]

Walls

[11] 4,396,468

[45] Aug. 2, 1983

[54] THREE PHASE GRAINING OF ALUMINUM SUBSTRATES

[75] Inventor: John E. Walls, Annandale, N.J.

[73] Assignee: American Hoechst Corporation, Somerville, N.J.

[21] Appl. No.: 332,392

[22] Filed: Dec. 21, 1981

[51] Int. Cl.[3] ..... C25D 11/16; C25D 11/18; C25D 3/04

[52] U.S. Cl. ..... 204/17; 204/33; 204/129.4; 204/129.75; 204/129.95

[58] Field of Search ..... 204/17, 33, 129.4, 38 E, 204/129.75, 129.85, 129.95

[56] References Cited

U.S. PATENT DOCUMENTS

| | | | |
|---|---|---|---|
| 2,598,043 | 5/1952 | Eichner | 148/6.27 |
| 3,929,591 | 12/1975 | Chu et al. | 204/17 |
| 3,935,080 | 1/1976 | Gumbinner et al. | 204/28 |
| 3,963,594 | 6/1976 | Brasko | 204/129.95 |
| 3,980,539 | 9/1976 | Lloyd et al. | 204/129.75 |
| 4,052,275 | 10/1977 | Gumbinner et al. | 204/129.95 |
| 4,201,836 | 5/1980 | Huang | 428/457 |
| 4,214,961 | 7/1980 | Anthony | 204/140 |

FOREIGN PATENT DOCUMENTS 2305243 2/1973 Fed. Rep. of Germany .

*Primary Examiner*—T. M. Tufariello
*Attorney, Agent, or Firm*—Richard S. Roberts

[57] ABSTRACT

A method for the production of aluminum substrates useful in the production of lithographic printing plates which comprises simultaneously electrochemically graining both sides of an aluminum sheet in an electrolyte employing three phase alternating current.

15 Claims, No Drawings

THREE PHASE GRAINING OF ALUMINUM SUBSTRATES

BACKGROUND OF THE INVENTION

The invention relates to the treatment of aluminum surfaces, and more particularly to the treatment of aluminum surfaces to provide a surface thereon suitable for use in the production of lithographic printing plates.

There are many methods and processes which have been heretofore employed in the treatment of aluminum surfaces to render them suitable for use in the production of lithographic printing plates. One such method involves the electrolytic treatment of aluminum, for example, electrolytic etching by use of a hydrochloric acid electrolyte. Various prior art publications, for example, U.S. Pat. Nos. 3,072,546 and 3,073,765 and British Pat. Nos. 879,768 and 896,563 describe the treatment of aluminum surfaces with hydrochloric acid while applying an alternating current to the aluminum plates to render the plates suitable for lithographic use.

In the treatment of such aluminum association alloys as 1100, a relatively large amount of electrical power has been required to obtain the degree of etching desired. It has also been found in the practice of the prior art processes that uniform etching of the surface is not obtained, and the character of the grain imparted to the surface is not consistent, portions thereof being relatively coarser than others, thus yielding an undesirable irregular surface which is not ideally suitable for lithographic use. When the surface of the aluminum sheet is irregular and non-uniform, it can interfere with the subsequent printing process when the surface is subsequently coated with a photosensitive resin as is employed in normal lithographic processes and is well known to the skilled worker.

Heretofore, various suggestions have been made to overcome the disadvantages encountered in the practice of the prior art processes. One such suggestion in U.S. Pat. No. 3,963,594 involves the use of a hydrochloric acid and gluconic acid electrolyte for etching. Other suggestions such as those contained in U.S. Pat. Nos. 3,342,711; 3,365,380 and 3,366,558 refer to an electrolytic polishing effect obtained on aluminum and other metals using a mixture which may include various electrolytes such as sulfuric acid and gluconic acid.

To date, all known processes for the electrochemical graining of aluminum have only been able to grain one side of the sheet. However, it is frequently desired to grain both sides of the sheet in a uniform manner. Past methods have required a costly double sequence graining treatment where one side of the sheet is grained first and then the other side is grained in a second step. Each one side graining step not only grains that full side but a portion of the edge of the reverse side. Thus when each side was heretofore singly grained, the edges of both sides were disadvantageously double grained causing a non-uniformity across the plate surfaces. All such methods employ single phase alternating current at line frequency (50 to 60 Hz) although an increased frequency is known to produce some benefits. The present invention very importantly provides surface uniformity from one side of the web to the other. This is most important when a lithographic printing plate is produced using a substrate made by the process of this invention because exposure of the light sensitive coating will be uniform from one side to the other with a predictable ink/water balance when printing. The present invention provides a method for uniformly graining both sides of an aluminum sheet substrate simultaneously employing three phase alternating current. Graining on each side of the web is noticed to be more uniform than two single phase graining operations under equivalent electrolyzing conditions. In addition, the graining is achieved at a substantial power savings over two sequential single phase one-sided graining treatments.

SUMMARY OF THE INVENTION

The present invention provides a method for simultaneously graining both sides of a metal sheet which comprises applying one leg of a three phase alternating current source to each of two electrodes disposed one on each of the opposite sides of said metal sheet and applying the third leg of said alternating current source to said metal sheet while maintaining said sheet and said electrodes in an electrolytic medium.

This system provides the ability to simultaneously grain both sides of a metal substrate. It is also observed that the total power required to obtain a two-sided grained sheet is substantially less than the sum of the power necessary to do each side separately. It is further observed that the grain is more uniform with a simultaneous two-sided process since the edges of the sheet are grained to substantially the same degree as the middle of the sheet. Such is not the case with double one-sided grainings. Also, the resultant surface is much more uniform in pore structure and substantially freer from pitting.

DETAILED DESCRIPTION OF THE PREFERRED EMBODIMENT

As hereinbefore mentioned, the present invention provides an improved method of electrochemically graining a metal sheet substrate, preferably aluminum and its alloys whereby both sides of the substrate are grained simultaneously and substantially uniformly from edge to edge.

The aluminum sheets or webs which may be employed in the practice of this invention, include those which are made from aluminum alloys which contain substantial amounts of impurities, including such alloys as Aluminum Association alloys 1100 and 3003. The thickness of the aluminum sheets which may be employed in the practice of this invention may be such as are usually and well known to be employable for such purposes, for example, those which are from 0.004 inches to 0.025 inches in thickness; however, the exact choice of aluminum sheet may be left to the discretion of the skilled worker.

In general, graining according to the invention is effected by disposing an electrode on each of two opposite sides of a sheet or web of the aluminum substrate material. The sheet and each of the electrodes are then connected to each of the three terminals of a three phase alternating current source while the sheet and electrodes are disposed in an electrolytic medium.

Typical electrolytic media include all those which are known to the skilled artisan for use in single sided electrochemical graining methods. Such include aqueous solutions of hydrochloric acid, nitric acid, aluminum salts of mineral acids, and chloride or phosphate ion containing compounds. In addition, optional electrolyte modifiers may be included in the electrolytic bath. Such include gluconic acid, tartaric acid, boric acid and peroxides, especially hydrogen peroxide. The exact parameters of the conditions under which the electrolytic graining may be carried out may be varied and are within the purview of the skilled worker, depending upon the results to be achieved in each specific case. Hence the concentration of the solute in the electrolyte generally can broadly vary from less than about 1% to the saturation point in the solvent.

The preferred concentration of solute ranges from about 3 to 20 grams per liter, more preferably 8 to 20 grams per liter, most preferably 10 to 15 grams per liter.

The preferred concentration of electrolyte modifiers ranges from about 1 gram per liter to about the saturation point, more preferably about 5 to 15 grams per liter, most preferably about 8 to 12 grams per liter.

Some media are described in U.S. Pat. Nos. 3,935,080; 3,943,065; 3,963,594; 3,980,539; 4,052,275; 4,201,836 as well as my two co-pending U.S. patent applications having Ser. Nos. 277,512 and 277,511 filed on June 26, 1981, all of which are incorporated herein by reference.

The present process uses 3 phase alternating current with the electrical service preferably arranged in a delta configuration, although a "Y" type will also work. A delta system is one in which each leg is 120° out of phase with each other and are of equal potential.

The aluminum sheet or web workpiece is electrically contacted to the B leg of a 3-phase step-down transformer. The A and C legs are electrically contacted to two graphite sheet electrodes. The graphite sheets are then placed on each side of the workpiece at a preferred distance of 1.5 cm.

The web may make electrical contact, for example, by a contact roll or wet-cell via a method well known in the art.

When the web and electrodes are immersed in the electrolytic media, a vigorous agitation of the electrolyte is very helpful wherein the electrolyte is forced to flow between the electrodes and the workpiece at a preferred velocity of 0.3 M/sec. or more. This flow is continuously flushing the gas that is generated, which insures no change in resistance at the surface. It further provides fresh electrolyte to maintain optimum graining conditions.

The electrodes are preferably composed of graphite, although other conductive substances such as lead or stainless steel may also be employed. The distance from the electrodes to the web is preferably less than about 10 cm, more preferably less than about 5 cm, and most preferably less than about 1.5 cm.

Typical non-limiting incoming line current is 60 amperes, 480 volt, three phase service. This is typically converted via a step-down transformer to 1320 amperes at from about 20 to about 25 volts. These values are not critical and may be varied by those skilled in the art for their specific use. Current density, on the other hand, is more important. Current flow from each electrode to the web is such that it will provide a current density on each side of the web of from about 30 to about 120 amps per square decimeter, preferably 40–100 A/dm$^2$ and most preferably 60–75 A/dm$^2$.

It has been noticed that not only does the simultaneous two side graining procedure produce a grain which is very uniform from edge to edge across the substrate, and from one side compared to the other, but the power consumption to produce a lithographically suitable surface is substantially reduced. The following example demonstrates this phenomenon.

EXAMPLE 1

A 10"×24" sheet of lithographic grade aluminum is immersed in an aqueous electrolyte comprising 13 g/l nitric acid and 65 g/l aluminum nitrate along with a graphite electrode spaced at a distance of 1.5 cm. One side of the sheet is grained by the application of 300 amperes of current for 60 seconds, thus using 6.6 kilowatts of power. The plate is then turned over and the reverse side is similarly grained for a total power consumption of 13.2 kilowatts. This represents a power requirement for a lithographically useful grain, although without the uniformity of the present invention, of 91.1 kilowatts per square meter.

A similar 10"×24" sheet of the same grade is immersed in the same electrolyte along with two electrodes, one on either side of the plate at a distance of 1.5 cm. Both sides of the sheet are grained by the application of 300 amperes per side, but only 52.8 seconds are required for graining. It is noticed that only 11.6 kilowatts of power are required to produce a substantially uniform, lithographically suitable grain to both surfaces. This converts to 80 kilowatts per square meter of aluminum surface or a 12% power savings.

Subsequent to the graining of the aluminum surface hereunder, the aluminum may be further treated to produce the desired lithographic printing plates. Thus, the electrolytically etched aluminum may be subsequently coated with a lithographically suitable photosensitive coating for such purposes. Such coatings typically comprise diazonium salts, quinone diazides, photopolymerizable compositions as well as optional binding resins, colorants, stabilizers, etc. as are well known in the art.

Alternatively, the electrolytically grained surface may be anodized, for example, with alternating or direct current in a suitable electrolyte, such as sulfuric or phosphoric acid, prior to the application to the thus anodized surface of a lithographically suitable photosensitive coating. One typical, though non-limiting anodization, would be treatment with direct current in an aqueous electrolyte solution comprised of from 8 to 22 percent by weight of sulfuric acid, and wherein the direct current voltage is from 10 to 25 volts, and the current density is from 10 to 20 amperes per square foot, to provide a hard, abrasion resistant, porous surface on said aluminum sheet.

As a further option, a hydrophilizing interlayer composition may be applied between the treated substrate and the lithographic photosensitive coating.

Interlayer compositions employable in the practice of this invention include those which may be applied as aqueous solutions, such as aqueous solutions of alkali metal silicate, such as sodium silicate, silicic acid, the Group IV-B metal fluorides, polyacrylic acid, the alkali zirconium fluorides, such as potassium zirconium hexafluoride, or hydrofluozirconic acid which are applied in concentrations of 0.5 to 20% by volume.

The invention may be further illustrated by the following examples:

EXAMPLE 2

A section of 1100 alloy aluminum (10"×24") was degreased in a conventional alkaline aqueous solution and then well rinsed. The treated plate was kept wet and then placed in a solution consisting of 13 g/l nitric acid and 65 g/l aluminum nitrate. The aluminum sheet was firmly connected to one leg of an AC source while at the same time being held rigidly in place by a non-conducting support. Uniformly opposing the aluminum work-piece was placed a graphite electrode at a distance of 1.5 cm. The electrode was connected to a second leg of an AC source. While agitating the solution between the aluminum and the graphite by circulation, a potential of 22 volts (60 Hz) was applied with a current flow of 300 amperes for 60 seconds. After treatment, the plate was well rinsed and dried. Microscopic observation showed that due to throwing power wrapping around to the non-treated side, all four edges were grained approximately by 1.0 cm. The treated side was uniformly, but lightly, grained in the middle. Near the edge, the grain was coarse with some aluminum dissolution at the edge. To use a plate prepared in such a manner would require producing an oversized plate and trimming the edge after processing.

Microscopic evaluation using a scanning electron microscope (1000X, 2000X and 5000X) confirmed the visual observation. The center section was uniform, but undertreated, by virtue of the shallow grain structure. Such a condition may be easily corrected by increased treatment time and/or increased amperage. More important was the scan of the sections near the edge. There was excessive pitting and more of a three dimensional structure to the grain than would be considered acceptable for a plate intended to give quality images having high resolution.

EXAMPLE 3

In like manner, as described in Example 2, a plate was prepared. After the prescribed processing, the plate was removed from the bath, turned around and reinserted into the system, thereby exposing the untreated side to the graphite electrode. This side of the plate was treated exactly as the first. Again, both visual and SEM evaluation confirmed a plate having an undergrained inner area while having over etched edges. The side treated initially was unchanged, thus resulting in an unacceptable two-sided plate.

EXAMPLE 4

In like manner, as described in Example 2, a plate was degreased and placed in a solution having the same make-up. The work-piece was connected to one leg of a three phase step-down transformer. The original graphite electrode was connected to a second leg. In addition, a similar graphite electrode was introduced on the opposite side and similarly attached to the third remaining leg. Both electrodes were equally spaced (1.5 cm) from the aluminum in the middle. Using an applied potential of 22 volts (60 Hz) and 530 amperes for 60 seconds, the plate was electrochemically grained. After treatment, the plate was removed, rinsed and blotted dry. The plate had a very uniform appearance on both sides in that they were exactly the same with no evidence of undergraining in the middle, coarseness near the edge or etching away of the aluminum.

Microscopic observation using the SEM (1000X, 2000X and 5000X) confirmed that the surface was very uniform from side to middle with no measurable difference in pore diameter. Further, there was no detection of any unwanted pitting.

What is claimed is:

1. A method for simultaneously graining both sides of a metal sheet which comprises applying one phase of a three phase alternating current source to each of two electrodes disposed one on each of the opposite sides of said metal sheet and applying the third phase of said alternating current source to said metal sheet while maintaining said sheet and said electrodes in an electrolytic medium.

2. The method of claim 1 wherein said metal comprises aluminum or the alloys thereof.

3. The method of claim 1 wherein said medium comprises an aqueous solution containing one or more compounds selected from the group consisting of nitric acid, hydrochloric acid, aluminum salts of mineral acids, chloride ion containing compounds and phosphate ion containing compounds.

4. The method of claim 3 wherein said electrolyte comprises nitric acid and aluminum nitrate.

5. The method of claim 3 wherein said electrolyte further comprises one or more compounds selected from the group consisting of gluconic acid, tartaric acid, boric acid and peroxides.

6. The method of claim 3 wherein the concentration of said compounds in said aqueous solution ranges from about 1% by weight to the saturation point.

7. The method of claim 1 wherein the current density applied on each side of the sheet ranges from about 30 to about 120 amperes per square decimeter.

8. The method of claim 1 further comprising the subsequent step of anodizing one or both sides of said sheet.

9. The metal sheet produced according to the method of claim 1, 2, 3, 4, 5, 6, 7 or 8.

10. A lithographic printing plate which comprises a lithographically suitable photosensitive composition applied to one or both surfaces of the sheet produced according to the method of claim 1, 2 or 8.

11. The lithographic printing plate of claim 10 wherein said photosensitive composition comprises a composition selected from the group consisting of diazonium salts, quinone diazides and photopolymerizable compositions.

12. The lithographic printing plate of claim 10 further comprising a hydrophilizing interlayer composition disposed between said sheet surface and said photosensitive composition.

13. The lithographic printing plate of claim 11 further comprising a hydrophilizing interlayer composition disposed between said sheet surface and said photosensitive composition.

14. The lithographic printing plate of claim 12 wherein said hydrophilizing composition comprises one or more compounds selected from the group consisting of alkali metal silicate, silicic acid, the Group IV-B metal fluorides, polyacrylic acid, the alkali zirconium fluorides, and hydrofluozirconic acid.

15. The lithographic printing plate of claim 13 wherein said hydrophilizing composition comprises one or more compounds selected from the group consisting of alkali metal silicate, silicic acid, the Group IV-B metal fluorides, polyacrylic acid, the alkali zirconium fluorides, and hydrofluozirconic acid.

* * * * *